US012729877B2

(12) United States Patent
Northcut et al.

(10) Patent No.: US 12,729,877 B2
(45) Date of Patent: Sep. 8, 2026

(54) AIR CONDITIONING UNIT CONDENSATE REMOVAL

(71) Applicant: Haier US Appliance Solutions, Inc., Wilmington, DE (US)

(72) Inventors: Jason Northcut, Louisville, KY (US); Benjamin Beyerle, Louisville, KY (US); Brice Alan Bowley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 55 days.

(21) Appl. No.: 18/604,977

(22) Filed: Mar. 14, 2024

(65) Prior Publication Data

US 2025/0290662 A1 Sep. 18, 2025

(51) Int. Cl.

| | |
|---|---|
| ***F24F 13/22*** | (2006.01) |
| ***F24F 11/70*** | (2018.01) |
| *F24F 140/30* | (2018.01) |

(52) U.S. Cl.

CPC ..... *F24F 13/222* (2013.01); *F24F 11/70* (2018.01); *F24F 2013/225* (2013.01); *F24F 2140/30* (2018.01)

(58) Field of Classification Search

CPC ..... F24F 13/222; F24F 11/70; F24F 2140/30; F24F 2013/225

See application file for complete search history.

(56) References Cited

U.S. PATENT DOCUMENTS

| | | | | |
|---|---|---|---|---|
| 5,461,879 | A | 10/1995 | Bolton et al. | |
| 8,840,729 | B1 | 9/2014 | Herren et al. | |
| 2005/0103721 | A1* | 5/2005 | Fritze | C02F 9/20 210/744 |
| 2009/0064698 | A1* | 3/2009 | Spanger | F24F 13/222 62/289 |
| 2016/0138209 | A1* | 5/2016 | Kitayama | D06F 58/20 34/131 |
| 2023/0349590 | A1 | 11/2023 | Zhang et al. | |

FOREIGN PATENT DOCUMENTS

| | | | |
|---|---|---|---|
| CN | 214949420 U | * | 11/2021 |
| JP | H08268671 A | * | 10/1996 |
| KR | 20190106560 A | | 9/2019 |

OTHER PUBLICATIONS

Mai et al., Mobile Air Conditioner, Nov. 30, 2021, CN214949420U, Whole Document (Year: 2021).*

Oura et al., Cooling Equipment for Elevator Car, Oct. 15, 1996, JPH08268671A, Whole Document (Year: 1996).*

* cited by examiner

*Primary Examiner* — Larry L Furdge

(74) *Attorney, Agent, or Firm* — Dority & Manning, P.A.

(57) ABSTRACT

An air conditioner unit includes an indoor heat exchanger, an outdoor heat exchanger, and a base pan below the indoor heat exchanger and the outdoor heat exchanger. Methods of operating the air conditioner unit may include, or a controller of the air conditioner unit may be configured for, detecting, with a level sensor, a level of condensate in the base pan above a predetermined threshold level and operating the air conditioner unit in a fan only mode in response to detecting the level of condensate above the predetermined threshold level.

14 Claims, 6 Drawing Sheets

AIR CONDITIONING UNIT CONDENSATE REMOVAL

FIELD OF THE INVENTION

The present subject matter relates generally to air conditioner units such as portable air conditioner units, and more particularly, to systems and methods for removing condensate from within such air conditioner units.

BACKGROUND OF THE INVENTION

Air conditioners or air conditioning appliance units are conventionally used to adjust the temperature within structures such as dwellings and office buildings. In particular, one-unit type room air conditioner units, such as portable air conditioners (PAC), single-package vertical units (SPVU), or package terminal air conditioners (PTAC) may be utilized to adjust the temperature in, for example, a single room or group of rooms of a structure. A sealed refrigerant system is generally housed within the air conditioner unit to treat (e.g., cool or heat) air as it is circulated through the air conditioner unit. One or more control boards are typically provided to direct the operation of various elements of the particular air conditioner unit.

During operation of the sealed refrigerant system, moisture from the air circulated through the air conditioner unit may accumulate, e.g., condense, on one or more components of the air conditioner unit. For example, the sealed refrigerant system typically includes at least two heat exchangers, one of which operates as an evaporator. As the air passes over, around, and/or through the evaporator, the temperature of the air is reduced and water vapor from the air condenses on and/or around the evaporator. Such condensate generally drains to a bottom of the air conditioner unit where the condensate is collected. The collected condensate may be permitted to evaporate from the bottom of the air conditioner unit and/or active condensate removal, such as one or more mechanisms which are configured to remove condensate from the bottom of the air conditioner unit, may be employed.

Even with active condensate removal, the rate of condensate accumulation at the bottom of the air conditioner unit may exceed the rate of condensate removal. If such conditions persist for a sufficient time, undesirable effects may occur. Accordingly, air conditioning units with features for managing condensate are desired in the art.

BRIEF DESCRIPTION OF THE INVENTION

Aspects and advantages of the invention will be set forth in part in the following description, or may be apparent from the description, or may be learned through practice of the invention.

In one example embodiment, a method of operating an air conditioner unit is provided. The air conditioner unit includes an indoor heat exchanger, an outdoor heat exchanger, and a base pan below the indoor heat exchanger and the outdoor heat exchanger. The method may include detecting a level of condensate in the base pan above a predetermined threshold level. The level of condensate in the base pan above the predetermined threshold level may be detected with a level sensor of the air conditioner unit. The method may also include operating the air conditioner unit in a fan only mode in response to detecting the level of condensate above the predetermined threshold level.

In another example embodiment, an air conditioner unit is provided. The air conditioner unit includes an indoor heat exchanger, an outdoor heat exchanger, and a base pan below the indoor heat exchanger and the outdoor heat exchanger. The air conditioner unit may include a controller. The controller of the air conditioner unit may be configured for detecting, with a level sensor, a level of condensate in the base pan above a predetermined threshold level and operating the air conditioner unit in a fan only mode in response to detecting the level of condensate above the predetermined threshold level.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
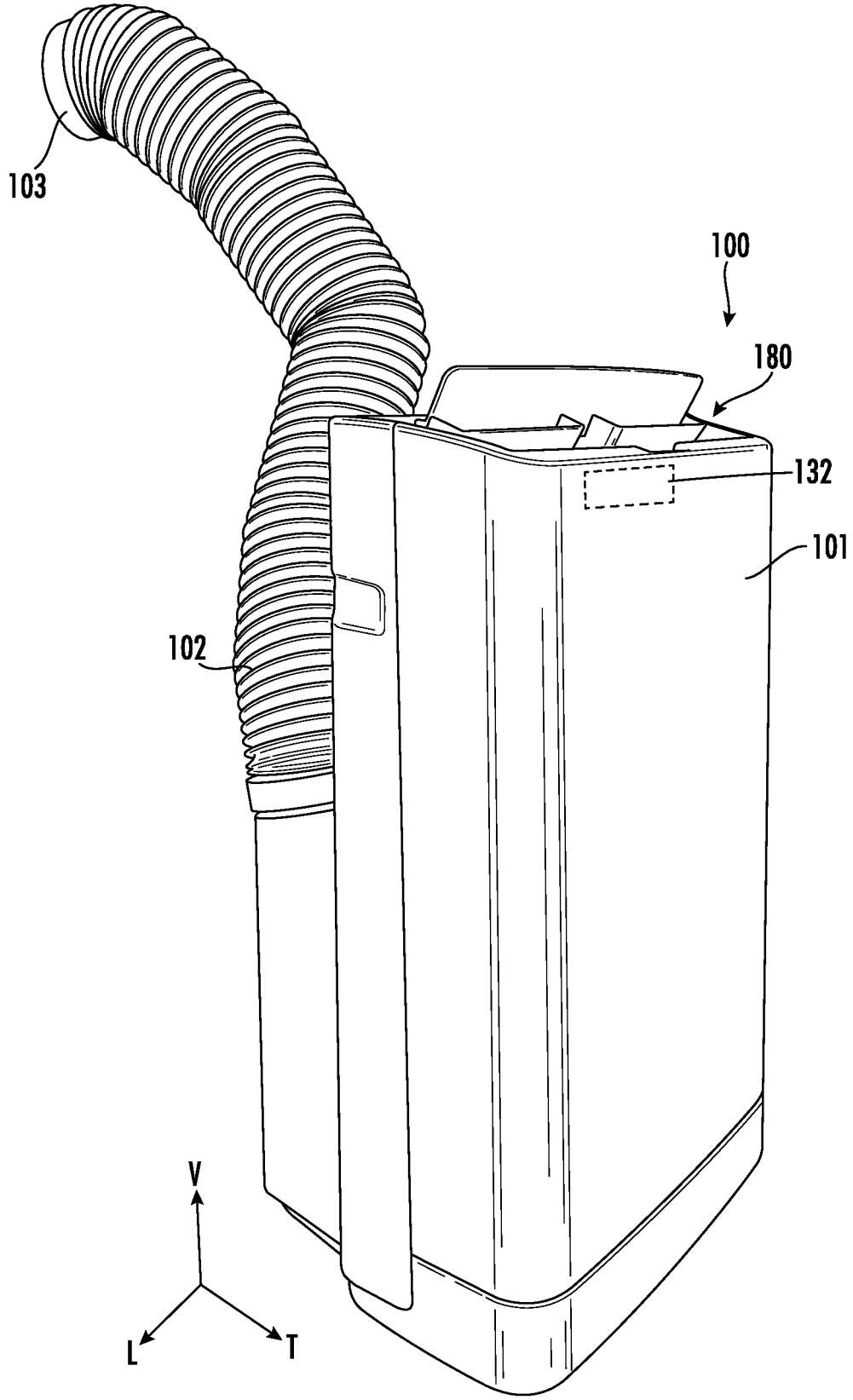
FIG. 1 provides a perspective view of an exemplary air conditioner unit in accordance with aspects of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
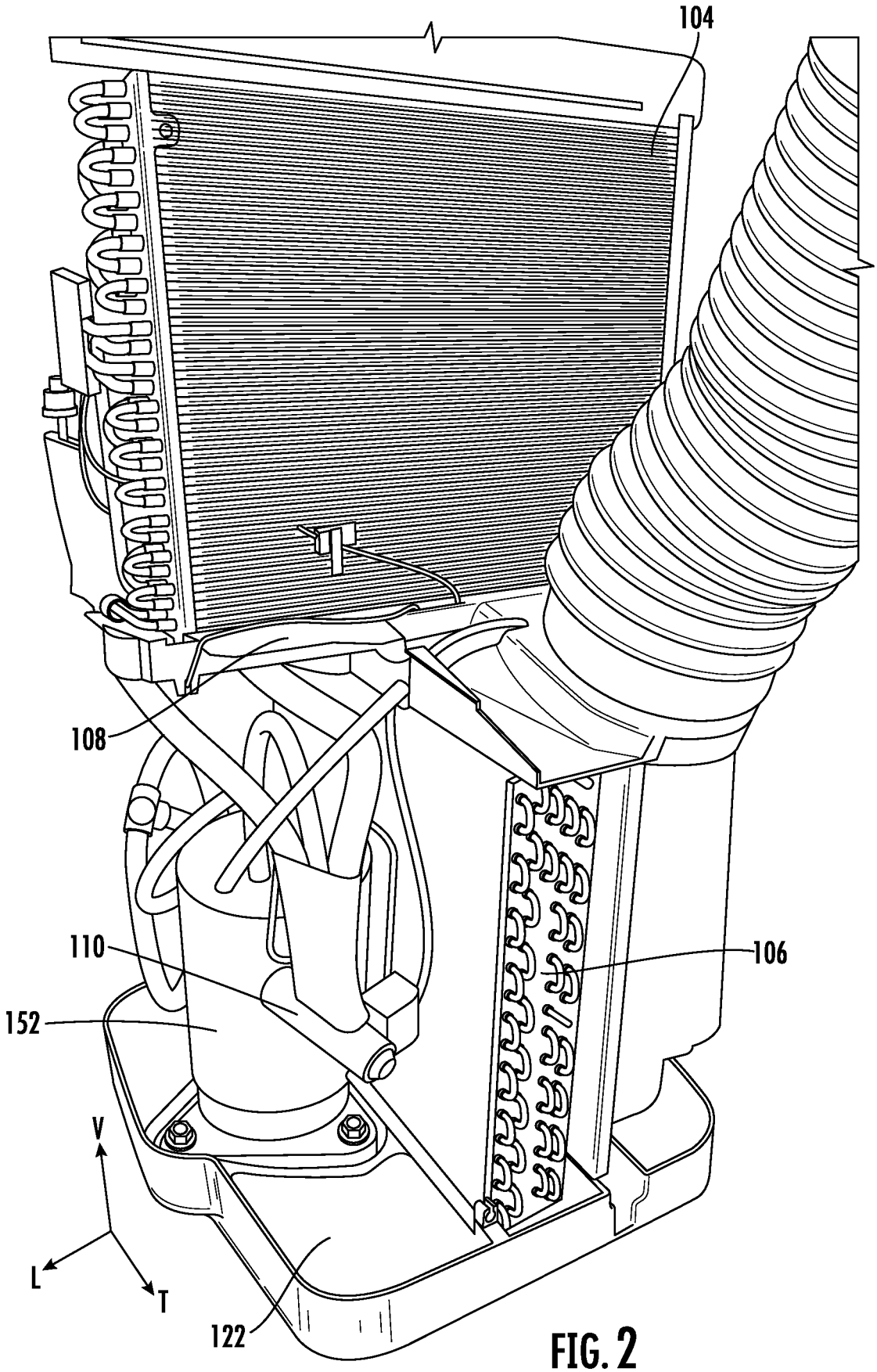
FIG. 2 provides a perspective view of the exemplary air conditioner unit of FIG. 1 with a housing thereof removed to show internal components of the exemplary air conditioner unit.

FIG. 1 provides a perspective view of an exemplary portable air conditioner unit (PAC) 100 according to one or more embodiments of the present subject matter. It will be understood that PAC 100 is provided by way of example only and that the present subject matter may be used in or with any suitable air conditioner unit in alternative example embodiments. As may be seen, e.g., in FIGS. 1 and 2, PAC 100 may define a vertical direction V, a lateral direction L, and a transverse direction T, which are mutually perpendicular and form an orthogonal direction system. It should be understood that relative positions and locations of certain aspects of PAC 100 may vary according to specific embodiments, spatial placement, or the like.

In general, as seen in FIG. 1, PAC 100 may include a housing or case 101 for enclosing other components of PAC 100. Case 101 may generally define the overall appearance of PAC 100, e.g., case 101 may be smooth or decorative to make PAC 100 visually appealing to a user. Generally, PAC 100 is operable to generate chilled and/or heated air in order to regulate the temperature of an associated room or structure. In other words, PAC 100 may be configured for operating in one of a heating mode and a cooling mode, as will be described below. As discussed in greater detail below, a sealed system 150 of PAC 100 is disposed within the casing 101. In some example embodiments, a vent hose 102 may extend from case 101. In general, vent hose 102 may direct exhaust air from PAC 100 to an external environment (e.g., outside of the conditioned space). For example, an end 103 of vent hose 102 may be positioned in a window of a structure to vent treated air outside of the structure. Moreover, an outlet 180 of PAC 100 may generally direct treated air to the conditioned space. For example, exhaust air may be directed to flow through vent hose 102 and treated air flowing through PAC 100 may be directed through outlet 180.

In general, sealed system 150 may include a compressor 152 (FIG. 5) and heat exchangers. As may be seen in FIG. 2, sealed system 150 within case 101 may include a first heat exchanger 104 and a second heat exchanger 106. In general, first heat exchanger 104 may be an indoor heat exchanger, e.g., may be positioned within a portion of the PAC 100 which communicates (e.g., exchanges air) with the conditioned space, whereby the first heat exchanger 104 may be generally configured to treat air which is provided to the conditioned space around the PAC 100, e.g., via the outlet 180. The second heat exchanger 106 may be an outdoor heat exchanger, e.g., may be positioned within a portion of the PAC 100 which communicates (e.g., exchanges air) with the external environment. Thus, for example in cooling mode, the second heat exchanger 106 may operate as a condenser where refrigerant in the sealed system enters the second heat exchanger 106 in gaseous (vapor) form, then the refrigerant releases heat from the refrigerant to the outdoor air as the refrigerant flows through the second heat exchanger 106, such that at least a portion of the refrigerant changes phase, e.g., condenses, from vapor to liquid at the second heat exchanger 106. Thus, a relatively warm (e.g., as compared to the air from the first heat exchanger 104, which operates as an evaporator in the cooling mode) flow of exhaust air (e.g., the air having been heated at the second heat exchanger 106 by absorbing heat from the refrigerant as described) may be generated from the second heat exchanger 106 during cooling mode, and such exhaust air may be removed via the vent hose 102 as described.

In some embodiments, first heat exchanger 104 may be mounted to second heat exchanger 106 by a bracket 108. In some example embodiments, first heat exchanger 104 may be approximately perpendicular, or any other suitable angle, to second heat exchanger 106. As shown, second heat exchanger 106 may be adjacent a base pan 112, e.g., second heat exchanger 106 may be mounted within or on base pan 112. In general, base pan 112 may define a bottom reservoir within the PAC 100. Generally, condensate from the operation of PAC 100 will flow, e.g., drip, into the base pan 112 under the influence of gravity.

PAC 100 further includes a controller 132 in communication with user inputs, such as buttons, switches and/or dials. Controller 132 regulates operation of PAC 100. Thus, controller 132 is in operative communication with various components of PAC 100, such as components of sealed system 150 and/or a temperature sensor, such as a thermistor or thermocouple, for measuring the temperature of the interior atmosphere. In particular, controller 132 may selectively activate sealed system 150 in order to chill or heat air around sealed system 150, e.g., in response to temperature measurements from the temperature sensor.

Controller 132 includes memory and one or more processing devices such as microprocessors, CPUs or the like, such as general or special purpose microprocessors operable to execute programming instructions or micro-control code associated with operation of PAC 100. The memory can represent random access memory such as DRAM, or read only memory such as ROM or FLASH. The processor executes programming instructions stored in the memory. The memory can be a separate component from the processor or can be included onboard within the processor. Alternatively, controller 132 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
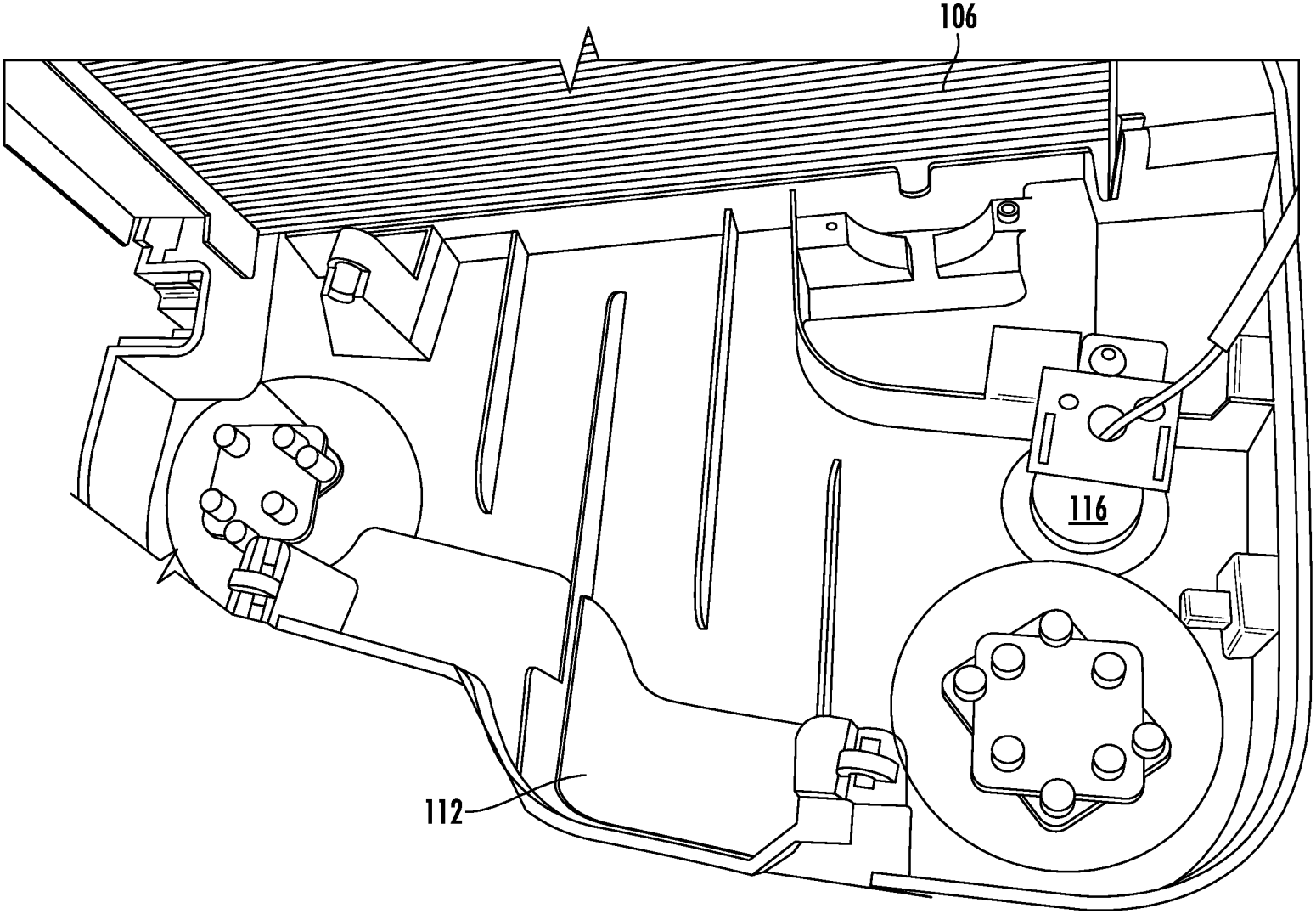
FIG. 3 provides a perspective view looking down into of a portion of an example base pan of the example portable air conditioner unit of FIG. 1
Figure 4:
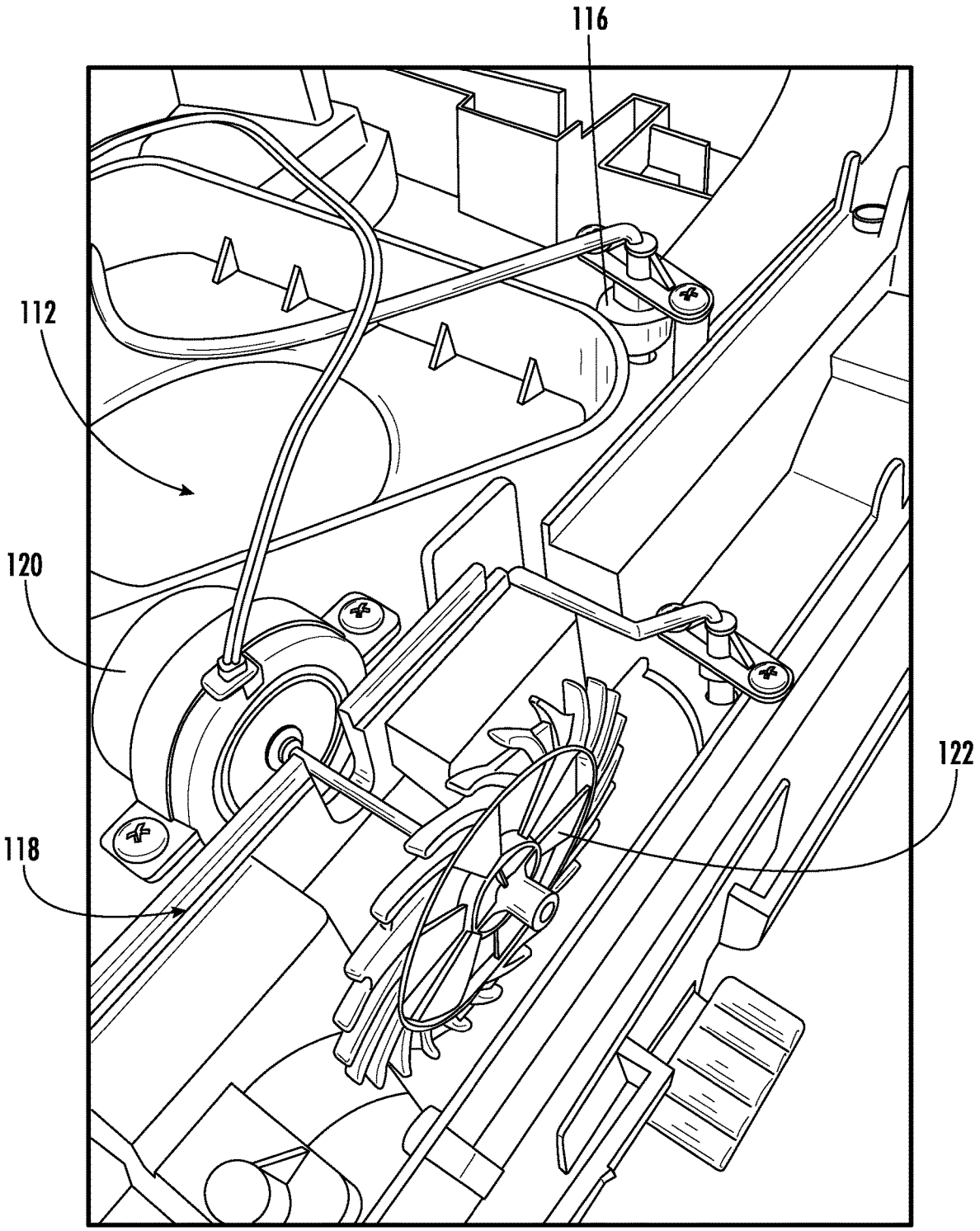
FIG. 4 provides another perspective view of a portion of the exemplary base pan.

As may be seen, e.g., in FIGS. 3 and 4, a level sensor 116 may be mounted within base pan 112. The level sensor 116 may be positioned and configured to detect or measure one or more fill levels in the base pan 112, e.g., an amount (such as a height) of condensate accumulated within the base pan 112. For example, the level sensor 116 may be a float switch and may thus be configured to detect when the condensate fill reaches a certain predetermined level. In some embodiments, multiple float switches may be provided at two or more vertical positions to detect multiple distinct predetermined levels of condensate within the base pan 112. In some embodiments, a single level sensor 116 may be provided and the single level sensor 116 may be configured to measure or detect multiple levels of condensate in the base pan 112. For example, such single level sensor 116 may be a multi-position float switch or a non-contact sensor such as a time of flight (optical) sensor, or an ultrasonic sensor. The structure and operation of such sensors are understood by those of ordinary skill in the art and, as such, are not specifically illustrated or described in further detail herein for the sake of brevity.

As may be seen, e.g., in FIG. 4, in some embodiments the PAC 100 may include a slinger motor 118. The slinger motor 118 may include a motor 120 which is mechanically coupled to a slinger wheel 122, such that rotation of the drive shaft of the motor 120 is transferred to the slinger wheel 122. The slinger wheel 122 may be positioned at least partially within the base pan 112 and configured to remove liquid, e.g., water such as condensate, from the base pan 112. When the slinger wheel 122 spins, the condensate may thus be slung, e.g., upwards, out of the base pan 112, such as to provide additional contact between the condensate and air in order to promote more rapid evaporation and/or to sling the condensate onto the second heat exchanger 106 (in particular when the PAC 100 is operating or has recently operated in the cooling mode such that the second heat exchanger 106 (e.g., outdoor heat exchanger) operates as the condenser in the sealed system 150) to promote evaporation of the condensate.

Figure 5:
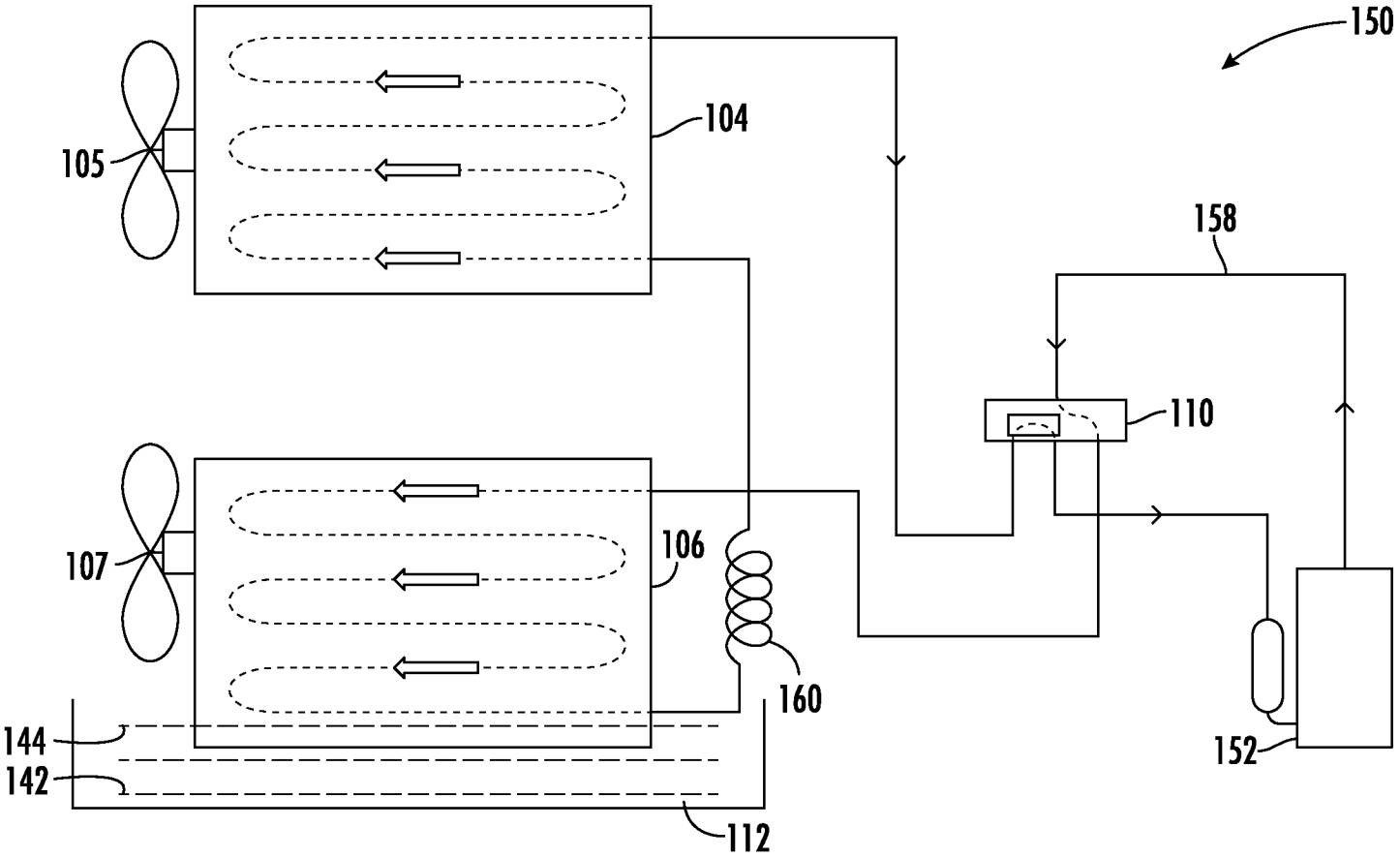
FIG. 5 provides a schematic diagram of an exemplary sealed refrigerant system for an air conditioner unit such as the exemplary air conditioner unit of FIG. 1.

Turning now to FIG. 5, a schematic illustration of an exemplary sealed refrigerant system 150 is provided. For purposes of explanation, the exemplary sealed refrigerant system 150 is illustrated in FIG. 5 and described herein as operating in a cooling mode. It will be understood by those of ordinary skill in the art that PAC 100 is also operable in a heat pump mode, in which the flow of refrigerant and the operation of the heat exchangers 104, 106 is generally reversed from the example cooling mode.

In general, when PAC 100 operates in the cooling mode, first heat exchanger 104 operates as an evaporator such that condensate condensed from first heat exchanger 104 drops through second heat exchanger 106, which operates as the condenser, then drips and collects in the base pan 112. Additionally, when PAC 100 operates in the heating mode such that second heat exchanger 106 operates as the evaporator, condensate may drop into base pan 112 from the second heat exchanger 106. The level sensor 116 (see, e.g., FIGS. 3 and 4) may be configured to detect one or more predetermined fill levels of condensate within the base pan 112, such as a first level 142 and a second level 144.

As may be seen in FIG. 5, sealed system 150 includes a compressor 152, first heat exchanger 104, and second heat exchanger 106. As is generally understood, various segments of any suitable tubing, piping, or conduit may be utilized to flow refrigerant between the various components of sealed system 150. Thus, for example, first heat exchanger 104, and second heat exchanger 106 may be in fluid communication with each other and compressor 152 via suitable conduit 158. The unlabeled arrows in FIG. 5 generally indicate the direction of refrigerant flow within and through the conduits 158 and heat exchangers 104, 106 of sealed system 150 in the exemplary cooling mode (the direction of refrigerant flow being reversed, e.g., by valve 110, in the heating mode).

As shown in FIG. 5, during operation of sealed system 150 in the cooling mode, compressor 152 operates to increase a pressure of the refrigerant within compressor 152. In particular, vapor refrigerant from first heat exchanger 104 is directed to compressor 152 while in the cooling mode. Vapor refrigerant from first heat exchanger 104 may be a fluid in the form of a superheated vapor. Upon exiting first heat exchanger 104, the refrigerant may enter compressor 152, and compressor 152 may operate to compress the refrigerant. Accordingly, the pressure and temperature of the refrigerant may be increased in compressor 152 such that the refrigerant becomes a more high-pressure superheated vapor.

When sealed system 150 is operating in the cooling mode, second heat exchanger 106 is disposed downstream of compressor 152, and second heat exchanger 106 acts as a condenser. Thus, second heat exchanger 106 is operable to reject heat into the exterior atmosphere, e.g., through vent hose 102 of casing 101, when sealed system 150 is operating in the cooling mode. For example, the superheated vapor from compressor 152 may enter second heat exchanger 106 via suitable conduit or piping 158 that extends between and fluidly connects compressor 152 and second heat exchanger 106. Within second heat exchanger 106, the refrigerant from compressor 152 transfers energy to the exterior atmosphere and condenses into a saturated liquid, a liquid-vapor mixture, and/or a subcooled liquid. An air handler or fan 107 may be positioned adjacent second heat exchanger 106 to facilitate or urge a flow of air across second heat exchanger 106 in order to facilitate heat transfer.

An expansion device 160 is disposed on conduit 158 between second heat exchanger 106 and first heat exchanger 104. In the cooling mode, liquid refrigerant from second heat exchanger 106 travels through expansion device 160 before flowing through first heat exchanger 104. Expansion device 160 may generally expand the refrigerant, thereby lowering its pressure and temperature. The refrigerant may then be flowed through first heat exchanger 104.

As used herein, expansion device may refer to any device suitable for throttling or expanding the refrigerant flowing through a conduit. For example, according to the illustrated embodiment, expansion device 160 is a capillary tube that allows refrigerant to expand after leaving second heat exchanger 106 prior to entering first heat exchanger 104. Other types, configurations, and locations of expansion devices, e.g., an electronic expansion valve, are possible and within the scope of the present subject matter.

First heat exchanger 104 is disposed on conduit 158 between expansion device 160 and compressor 152. In this manner, when sealed system 150 is operating in the cooling mode, first heat exchanger 104 is disposed downstream of expansion device 160 and acts as an evaporator. Thus, first heat exchanger 104 is operable to heat refrigerant within first heat exchanger 104 when sealed system 150 is operating in the cooling mode. For example, within first heat exchanger 104, the refrigerant from expansion device 160 receives energy and vaporizes into superheated vapor and/or high quality vapor mixture. An air handler or fan 105 may be positioned adjacent first heat exchanger 104 to facilitate or urge a flow of air across first heat exchanger 104 in order to facilitate heat transfer. As mentioned above, the sealed system 150 may also be operable in a heating mode, e.g., a valve 110 (such as a reversing valve, four-way valve, etc.) reverses the direction of refrigerant flow through sealed system 150. Thus, in the heating mode, first heat exchanger 104 is disposed downstream of compressor 152 and acts as a condenser, e.g., such that first heat exchanger 104 is operable to reject heat into the conditioned space, e.g., the room in which PAC 100 is located. The refrigerant from first heat exchanger 104 travels through expansion device 160, which may generally expand the refrigerant, thereby lowering its pressure and temperature, as described above. The refrigerant may then flow through second heat exchanger 106.

Figure 6:
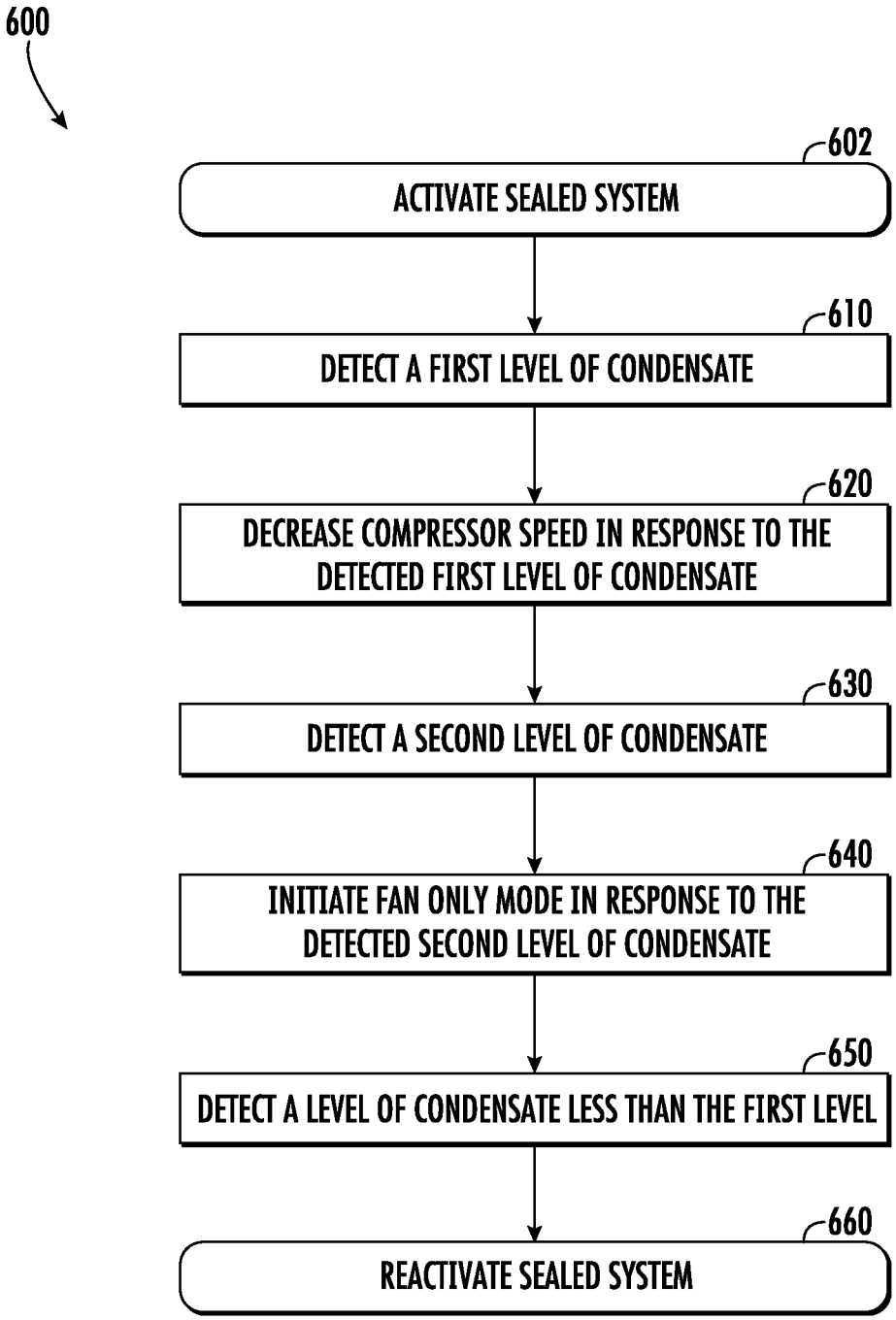
FIG. 6 provides a flow diagram of an example method of operating an air conditioner unit in accordance with aspects of the present disclosure.

Turning now to FIG. 6, embodiments of the present disclosure may also include methods of operating an air conditioner system, such as the example method 600 illustrated in FIG. 6. Such methods may be used with any suitable air conditioner system or air conditioner unit, such as PAC 100 as described above.

For example, as mentioned above, the PAC 100 may include a controller 132 and the controller 132 may be operable for, e.g., configured for, performing some or all of the methods and/or steps thereof described herein. For example, one or more method steps may be embodied as an algorithm or program stored in a memory of the controller 132 and executed by the controller 132.

As illustrated in FIG. 6, method 600 may begin with activating a sealed system of the air conditioner unit, e.g., as indicated at (602). The sealed system may be, e.g., sealed system 150 as described above. Activating the sealed system generally includes operating a compressor, e.g., compressor 152, of the sealed system whereby refrigerant is urged through the sealed system. In various embodiments, the sealed system may be activated at (602) in the cooling mode or in the heating mode. Thus, the sealed system may include two or more heat exchangers, at least one of which operates as an evaporator when the sealed system is activated at (602). Thus, condensate may be generated within the air conditioner unit during such operation, e.g., at and/or around the evaporator, and such condensate may flow, e.g., drip or otherwise flow downward by gravity, into the base pan (e.g., base pan 112) and may accumulate therein.

Method 600 may further include detecting a level of condensate in the base pan above a predetermined threshold level. For example, the level of condensate in the base pan may be detected with a level sensor, such as level sensor 116 described above. In some embodiments, the level sensor may be or may include a float switch positioned at the predetermined threshold level and the float switch may thus be actuated by the condensate when the condensate accumulates up to the predetermined threshold level, as is generally understood by those of ordinary skill in the art. As indicated at (610) and (630) in FIG. 6, the predetermined threshold level may be a first level of condensate (e.g., 610) or a second level of condensate (e.g., 630).

In response to and based on the detected condensate level reaching one or more predetermined threshold levels, method 600 may include remedial actions to prevent or reduce additional accumulation of condensate in the drain pan. For example, in some embodiments, only one predetermined level of condensate in the base pan may be detected, and the method may then go directly to a fan only mode, whereas in additional embodiments where more than one predetermined level of condensate in the base pan is detected and the compressor is a variable speed compressor, the compressor may be slowed when a lower level of condensate in the base pan is detected and then the compressor may be shut down (e.g., PAC 100 may be switched to fan only mode) when another, higher, level of condensate in the base pan is detected.

For example, as illustrated in FIG. 6, method 600 may include (620) decreasing compressor speed in response to the first level of condensate in the base pan that was detected at (610). Thus, the rate of condensation at the evaporator may be reduced, e.g., the temperature at the evaporator may increase when the compressor speed is decreased, whereby the rate of condensation at the evaporator may be reduced and consequently the rate of condensation flow to the base pan also may be reduced. As another example, method 600 may also or instead include (640) operating the air conditioner unit in a fan only mode, e.g., initiating the fan only mode, in response to detecting the level of condensate above the predetermined threshold level, such as when the predetermined threshold level is a second predetermined threshold level, e.g., the fan only mode may be initiated in response to (630) detecting the second level of condensate in the base pan, e.g., above the second predetermined threshold level. In embodiments which include both the first level and the second level, the first level may be less than the second level. Thus, in such embodiments, exemplary methods according to the present disclosure may include slowing (to a speed greater than zero) the compressor at a first, lower, level of condensate in the base pan and, if slowing the compressor is not sufficient, e.g., such that the condensate continues to accumulate until the second, higher, level is reached, the compressor may then be fully stopped and deactivated, such as the air conditioner unit may be operated in a fan only mode, where air circulation may still be provided while reducing or stopping the formation of condensate at the evaporator.

Such remedial actions, e.g., slowing or stopping the compressor, may be contrary to a user input or a command from the controller 132 (such command may be generated in response to and based on the user input or may be otherwise generated). For example, the command from the controller 132 may be a call for cooling, in response to which the air conditioner unit would normally operate in the cooling mode in order to provided chilled air to the conditioned space, or a call for heating, etc. Thus, for example, operating the air conditioner unit in the fan only mode may include overriding a user input and/or a command from the controller, such as deactivating the compressor of the sealed system of the air conditioner unit regardless of a call for heating or for cooling.

In some embodiments, once the condensate level has been safely reduced, e.g., when a level of condensate in the base pan less than the first level is detected as indicated at (650) in FIG. 6, which may occur after slowing and/or stopping the compressor at (620) and/or (640), the air conditioner unit may return to normal operation. Normal operation includes providing heating or cooling to the conditioned space in response to a user input such as a set point temperature, a mode selection (e.g., heating mode selection or cooling mode selection), or one or more other similar inputs, or combinations of such inputs. For example, as indicated at (660) in FIG. 6, exemplary methods such as method 600 may include reactivating the sealed system of the air conditioner unit, e.g., reactivating the compressor, in response to the reduced level of condensate in the base pan such as in response to detecting the level of condensate less than the first level.

In other instances, the level of condensate in the base pan may continue to increase. For example, in some cases, another level of condensate may be detected which is greater than the one or more levels previously discussed. For example, the level of condensate in the base pan may be a first level, such as the level in response to which the fan only mode is initiated may be the first level. In such embodiments, the method may further include detecting another level, e.g., a second (or third, etc.) level, of condensate in the base pan greater than the first level of condensate in the base pan (or level other than first at which the fan only mode is initiated) after operating the air conditioner unit in the fan only mode (where the fan only mode was initiated in response to detecting the level of condensate above the predetermined threshold level, e.g., first level). Such methods may also include deactivating the air conditioner unit in response to detecting the second level of condensate in the base pan (or other level greater than the level at which the fan only mode was initiated), where deactivating the air conditioner unit includes deactivating the entire unit including every component (e.g., any and all fans as well as the compressor). An alert or alarm may also be provided, and a user notification to manually drain the base pan may be provided as well as or instead of the alert/alarm when (e.g., based on and in response to) the condensate reaches the second level or other predetermined level greater than the level at which the fan only mode was initiated.

As mentioned, the air conditioner unit may include one or more active condensate removal means, such as a slinger motor. In some embodiments, the slinger motor may be activated, e.g., the method may include running the slinger motor, in response to detecting the level of condensate above the predetermined threshold level. In some cases, the slinger motor (or other active condensate removal means) may be activated prior to detecting the level of condensate in the base pan at the predetermined threshold level. Thus, the method may include continuing to run the slinger motor and/or accelerating the slinger motor in response to detecting the level of condensate above the predetermined threshold level. In such embodiments, the active condensate removal, e.g., slinger motor, may be activated at the same level as the compressor is slowed or stopped, or may be activated at a distinct level, such as at a lower predetermined threshold level of condensate less than the level(s) at which the compressor is slowed/stopped.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an air conditioner unit, the air conditioner unit comprising an indoor heat exchanger, an outdoor heat exchanger, and a base pan below the indoor heat exchanger and the outdoor heat exchanger, the method comprising:

detecting, with a level sensor, a level of condensate in the base pan above a predetermined threshold level, wherein the level sensor comprises a float switch;

operating the air conditioner unit in a fan only mode in response to detecting the level of condensate above the predetermined threshold level; and running a slinger motor of the air conditioner unit in response to detecting the level of condensate above the predetermined threshold level with the float switch.

2. The method of claim 1, wherein operating the air conditioner unit in the fan only mode comprises deactivating a compressor of a sealed system of the air conditioner unit.

3. The method of claim 1, wherein the level of condensate in the base pan is a second level and the predetermined threshold level is a second predetermined threshold level, further comprising detecting a first level of condensate in the base pan above a first predetermined threshold level before detecting the level of condensate in the base pan above the second level, the first predetermined threshold level less than the second predetermined threshold level, and reducing a speed of a variable speed compressor of the air conditioner unit in response to detecting the first level of condensate in the base pan above the first predetermined threshold level.

4. The method of claim 3, wherein the level sensor is a second level sensor, and wherein the first level of condensate in the base pan above the first predetermined threshold is detected with a first level sensor.

5. The method of claim 3, wherein the float switch of the level sensor is a multi-position float switch and the first level of condensate in the base pan above the first predetermined threshold is detected with the level sensor.

6. The method of claim 1, wherein operating the air conditioner unit in the fan only mode comprises overriding a user input.

7. The method of claim 1, wherein the level of condensate in the base pan is a first level, further comprising detecting a second level of condensate in the base pan greater than the first level of condensate in the base pan after operating the air conditioner unit in the fan only mode in response to detecting the level of condensate above the predetermined threshold level, and deactivating the air conditioner unit in response to detecting the second level of condensate in the base pan.

8. An air conditioner unit comprising:

an indoor heat exchanger;

an outdoor heat exchanger;

a base pan below the indoor heat exchanger and the outdoor heat exchanger;

a level sensor comprising a float switch; and a controller, the controller configured for:

detecting, with the float switch of the level sensor, a level of condensate in the base pan above a predetermined threshold level;

operating the air conditioner unit in a fan only mode in response to detecting the level of condensate above the predetermined threshold level; and running a slinger motor of the air conditioner unit in response to detecting, with the float switch, the level of condensate above the predetermined threshold level.

9. The air conditioner unit of claim 8, wherein operating the air conditioner unit in the fan only mode comprises deactivating a compressor of a sealed system of the air conditioner unit.

10. The air conditioner unit of claim 8, wherein the level of condensate in the base pan is a second level and the predetermined threshold level is a second predetermined threshold level, further comprising detecting a first level of condensate in the base pan above a first predetermined threshold level before detecting the level of condensate in the base pan above the second level, the first predetermined threshold level less than the second predetermined threshold level, and reducing a speed of a variable speed compressor of the air conditioner unit in response to detecting the first level of condensate in the base pan above the first predetermined threshold level.

11. The air conditioner unit of claim 10, wherein the level sensor is a second level sensor, and wherein the first level of condensate in the base pan above the first predetermined threshold is detected with a first level sensor.

12. The air conditioner unit of claim 10 wherein the float switch of the level sensor is a multi-position float switch and the first level of condensate in the base pan above the first predetermined threshold is detected with the level sensor.

13. The air conditioner unit of claim 8, wherein operating the air conditioner unit in the fan only mode comprises overriding a user input.

14. The air conditioner unit of claim 8, wherein the level of condensate in the base pan is a first level, further comprising detecting a second level of condensate in the base pan greater than the first level of condensate in the base pan after operating the air conditioner unit in the fan only mode in response to detecting the level of condensate above the predetermined threshold level, and deactivating the air conditioner unit in response to detecting the second level of condensate in the base pan.

* * * * *